US006074249A

United States Patent [19]

Beken et al.

[11] Patent Number: 6,074,249

[45] Date of Patent: Jun. 13, 2000

[54] MINIATURE BOARDLOCK FOR AN ELECTRICAL CONNECTOR

[75] Inventors: Alan John Beken, Bucks; Michael James Greener, Framington; James David Hutchinson, London; Paul Dennis Jeffery, West Yelland; Frank Michael Reginald Wheeler-King, Berkhamsted, all of United Kingdom

[73] Assignee: The Whitaker Corporation, Wilmington, Del.

[21] Appl. No.: 09/190,154

[22] Filed: Nov. 12, 1998

[30] Foreign Application Priority Data

Nov. 18, 1997 [GB] United Kingdom ..... 9724370

[51] Int. Cl.[7] ..... H01R 13/73

[52] U.S. Cl. ..... 439/567

[58] Field of Search ..... 439/567, 571–572

[56] References Cited

U.S. PATENT DOCUMENTS

| | | | |
|---|---|---|---|
| 4,701,140 | 10/1987 | Orbanic | 439/751 |
| 4,759,721 | 7/1988 | Moore et al. | 439/82 |
| 4,795,353 | 1/1989 | Baker | 439/92 |
| 5,108,312 | 4/1992 | Sampson | 439/607 |
| 5,135,403 | 8/1992 | Rinaldi | 439/82 |
| 5,169,322 | 12/1992 | Frantz et al. | 439/82 |
| 5,213,515 | 5/1993 | Ishikawa et al. | 439/79 |
| 5,234,762 | 8/1993 | Palone | 438/336 |
| 5,295,862 | 3/1994 | Mosquera | 439/567 |
| 5,336,111 | 8/1994 | Thrush et al. | 439/567 |
| 5,356,313 | 10/1994 | Niwa et al. | 439/567 |
| 5,393,247 | 2/1995 | DiOrazio et al. | 439/567 |

FOREIGN PATENT DOCUMENTS

| | | | |
|---|---|---|---|
| 0 320 629 | 6/1989 | European Pat. Off. | H01R 9/09 |
| 0 366 964-A1 | 5/1990 | European Pat. Off. . | |

*Primary Examiner*—Gary F. Paumen

[57] ABSTRACT

An electrical connector for mounting on a substrate, the connector comprising a housing having a base surface and a boardlock for mechanically retaining the connector to the substrate the boardlock having a mounting portion fixed to the housing and a retention member extending outward from the base surface to be received in a hole in the substrate where the connector is characterized in that the retention member includes abutment surfaces that co-operate with the connector to assure the retention members are properly received in the holes of the substrate.

3 Claims, 5 Drawing Sheets

MINIATURE BOARDLOCK FOR AN ELECTRICAL CONNECTOR

BACKGROUND OF THE INVENTION

1. Field of the Invention

This invention relates to mechanically fixing an electrical connector to substrates, such as printed circuit board, or in particular to devices commonly known as boardlocks.

2. Description of the Prior Art

Printed circuit boards that are loaded with associated electronic components are widely used throughout the electronic industry. In order to interface with these boards, electrical connectors are also attached to the boards with their contacts being connected with circuit traces thereupon. In order to mechanically fix these connectors to the printed circuit boards, it is known to use a device commonly called a boardlock. Typically, the boardlock provides an mechanical anchor to the board such that the connector is held in place and any forces exerted as a result of mating or de-mating can be isolated in the connector housing as opposed to being transferred to the electrical interface between contact and circuit trace.

One conventional form of boardlock extends through a hole in the printed circuit board where it is deformed on the opposite side in a manner that prevents withdraw from the hole. Other boardlocks utilize retention arms that engage the inside surface of the hole such that it is not possible to pull the connector free of the board. Boardlocks have found common use in electrical connectors that utilize contacts having both pins for engaging through-hole on the circuit traces or surface mount feet for being soldered directly to a traces. A problem with the known boardlocks exists when the size of the printed circuit board becomes small. In these instances, the thickness is generally reduced thereby making it difficult for barbs to engage along the inner surface of the hole. In high density applications, typically both sides of the printed circuit board will be used which presents a further problem of either getting the tooling in the proper area to deform the boardlock or that the boardlock extending through the board is taking valuable board area. An example of one of these high density boards is 1.6 mm thick having a 2 mm diameter mounting holes where the size of the holes could have a tolerance ±0.127 mm. Additionally, in these high density applications where small connectors that are surface mounted are used, it is desirable that the boardlock also performs the function of holding the connector in place while the board is being processed prior to soldering of the contacts to the circuit traces. The processing sometimes includes inverting the board.

Finally, it is an additional problem that the mechanical strength of the material used for the boardlock in such a small application is usually low. The boardlock, if not properly inserted, could be deformed and destroyed thereby disrupting the manufacturing process.

SUMMARY OF THE INVENTION

These and other problems are solved by an electrical connector for mounting on a substrate, the connector comprising; a housing having a base surface and a boardlock for mechanically retaining the connector to the substrate the boardlock having a mounting portion fixed to the housing and a retention member extending outward from the base surface to be received in a hole in the substrate; characterized in that; the retention member includes abutment surfaces that co-operate with the connector to assure the retention members are properly received in the holes of the substrate.

It is an advantage of this boardlock that it can be used to hold connectors on extremely thin substrates without protruding through. It is another advantage of this boardlock that is adaptable to retain the connector in situations where the tolerance of hole size is relatively large compare to the diameter. It is another advantage that the connector can be placed in position with an minimum load that does not destroy the boardlock.

DETAILED DESCRIPTION OF THE PREFERRED EMBODIMENT

Figure 1:
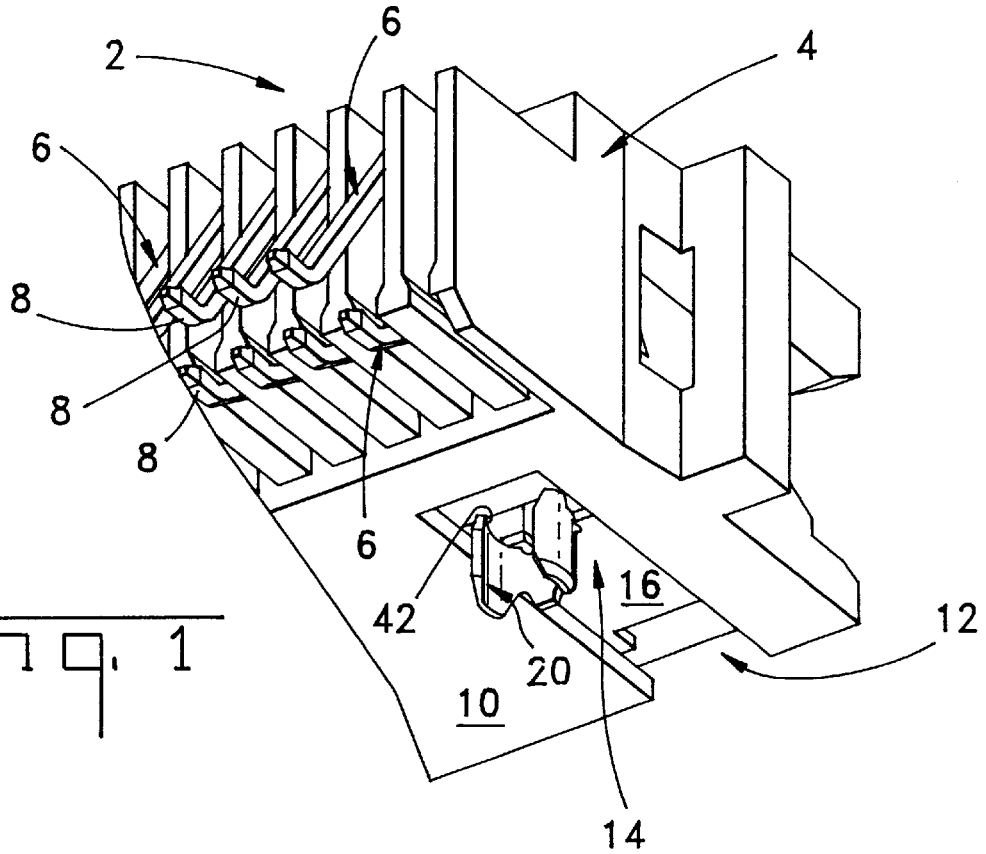
FIG. 1 is a partial underside isometric view of an electrical connector incorporating a boardlock according to the present invention.

With reference first to FIG. 1, an electrical connector according to the present invention is shown generally at 2. The electrical connector includes a housing 4 where in a plurality of contacts 6 are disposed. The contacts 6 include surface mount feet 8 constructed for surface mount soldering on a substrate 9 (FIG. 2) by such techniques as wave of soldering. The housing 4 further includes a base surface 10 that will correspond to the substrate 9 when the connector 2 is mounted thereupon. A channel 12 is formed in the housing 4 along the base surface 10 for receiving a boardlock 14.

Figure 2:
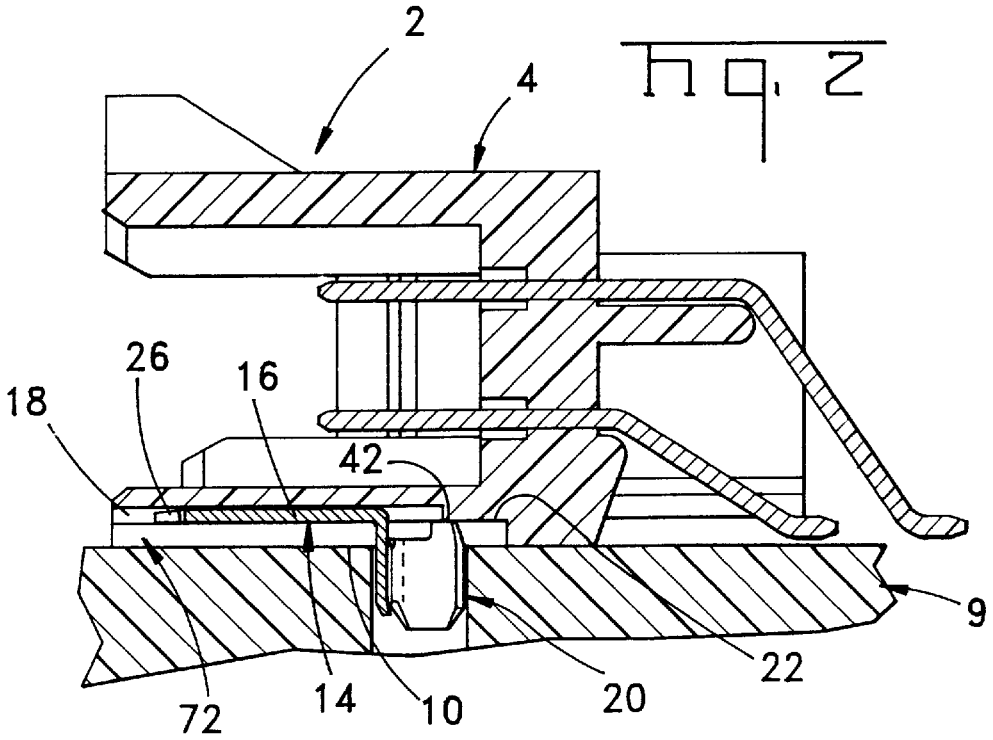
FIG. 2 is a side sectional view of the electrical connector of FIG. 1.

With reference now to FIG. 2, the electrical connector 2 is further shown on the substrate 9 where the boardlock 14 is shown with a mounting portion 16 received within groove 18 of channel 10. Extending perpendicularly from the mounting tab 16 is a retention portion 20 that extends outward from the base surface 10 of the connector housing 4. The channel 12 of the connector housing 4 further includes a support surface 22 for supporting the retention portion 20 of the boardlock 14 as will be described below.

Figure 3:
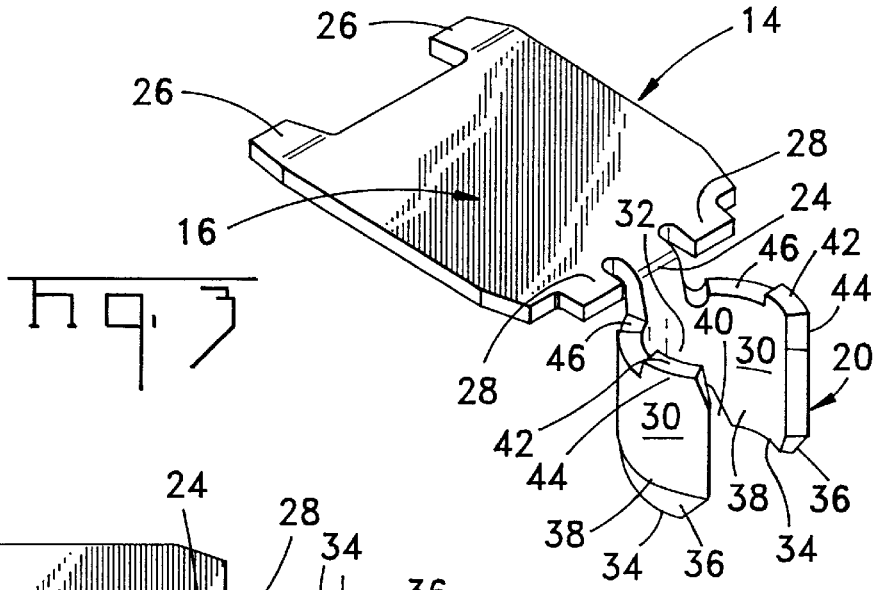
FIG. 3 is an upper perspective view of the boardlock incorporated into the connector of FIG. 1.
Figure 4:
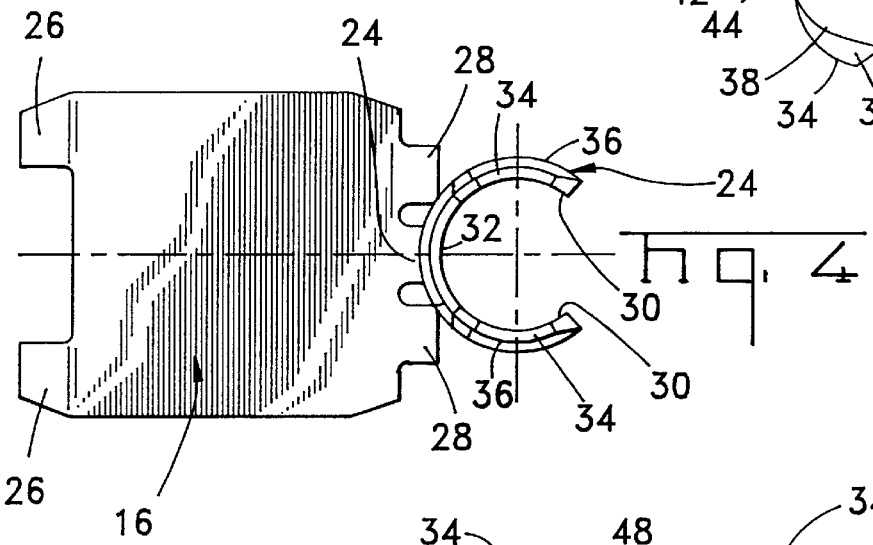
FIG. 4 is a bottom view of the boardlock of FIG. 3.
Figure 5:
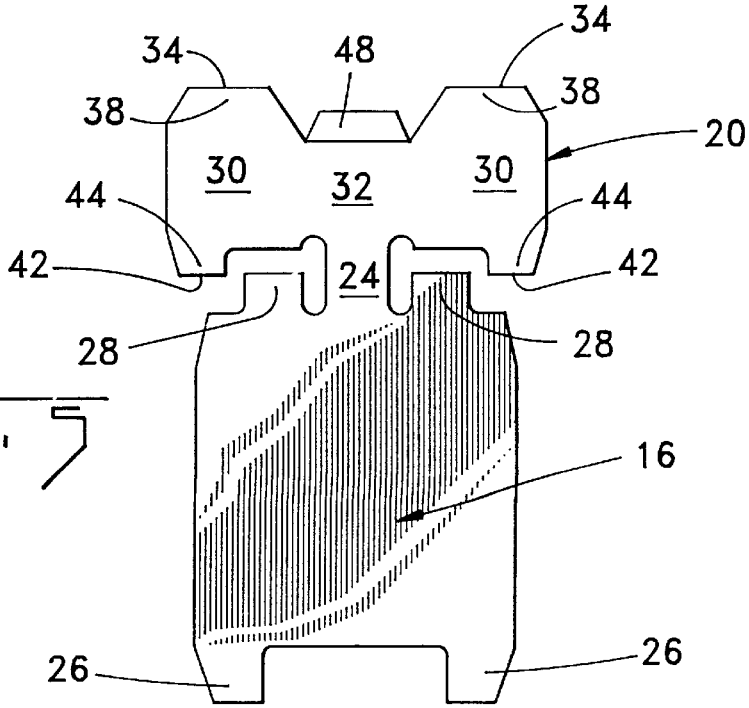
FIG. 5 is a plan view of the stamping used to form the boardlock of FIG. 3.
Figure 6:
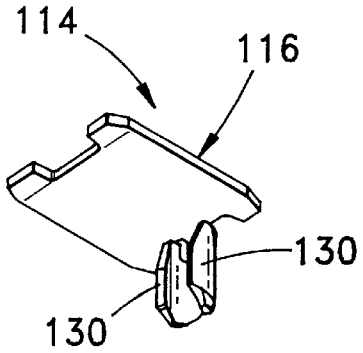
FIG. 6 is a bottom perspective view of an alternative embodiment of a boardlock according to the present invention.
Figure 7:
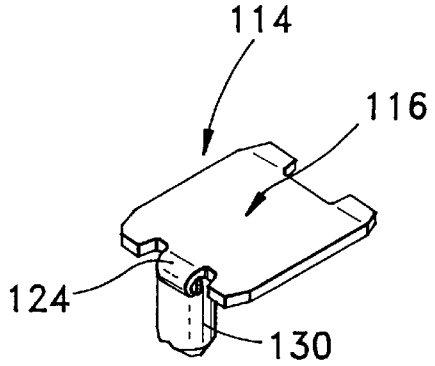
FIG. 7 is an upper perspective view of the boardlock of FIG. 6.
Figure 8:
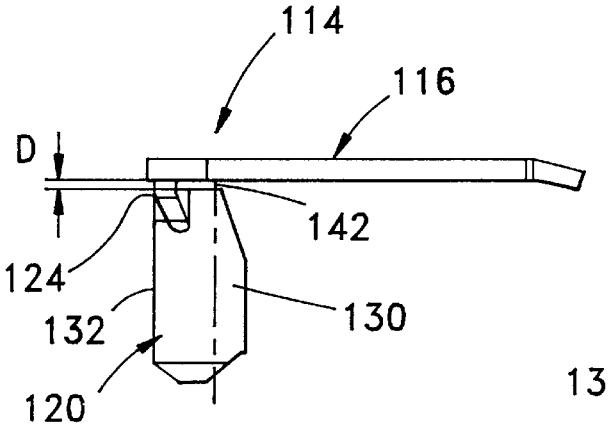
FIG. 8 is a side view of the boardlock of FIG. 6.
Figure 9:
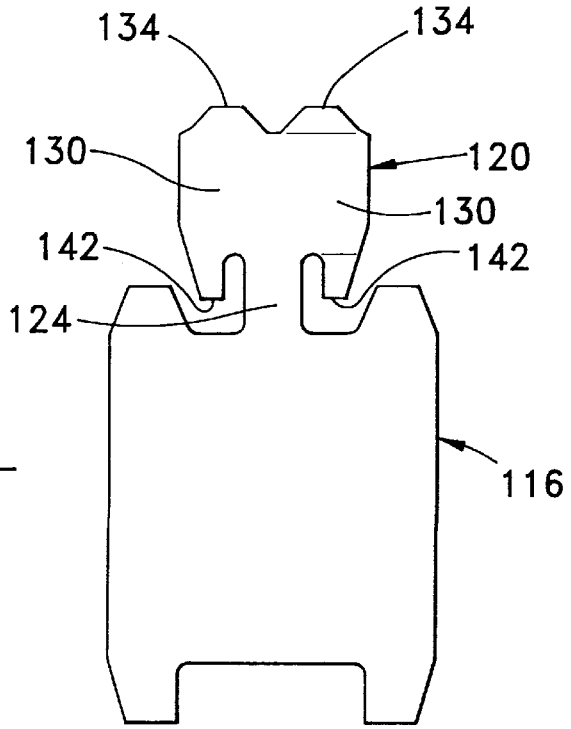
FIG. 9 is plan view of the stamping used to form the boardlock of FIG. 6.
Figure 10:
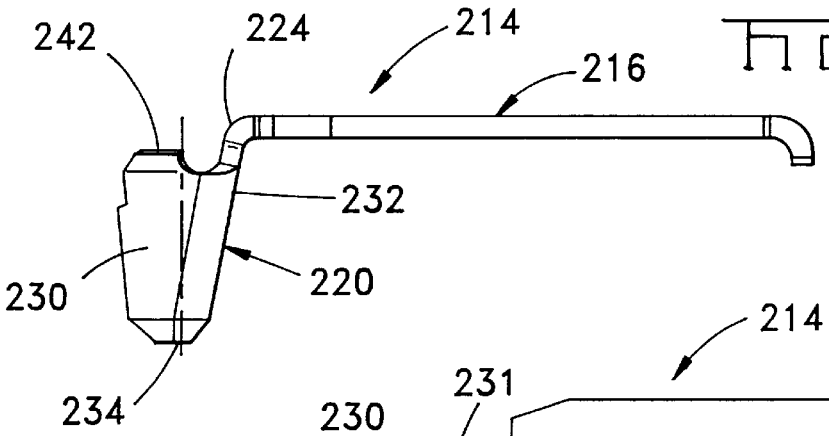
FIG. 10 is a side view of another alternative embodiment of a boardlock according to the present invention.
Figure 11:
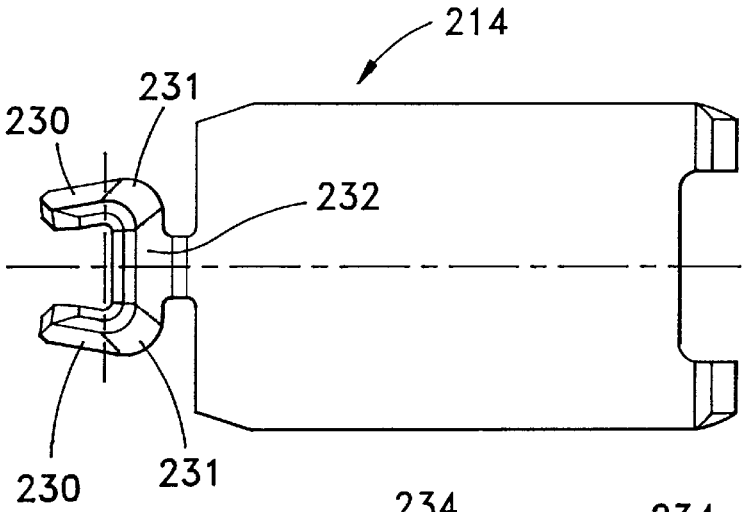
FIG. 11 is a bottom view of the boardlock of FIG. 10.
Figure 12:
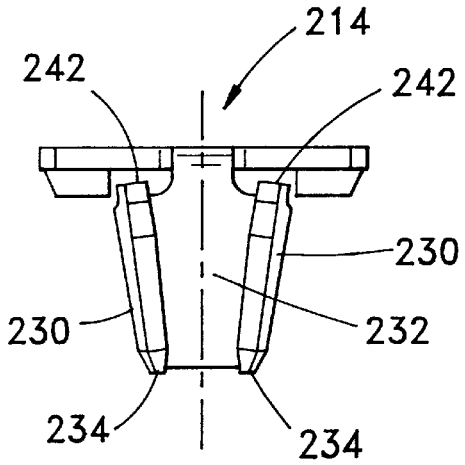
FIG. 12 is an end view of the boardlock of FIG. 10.
Figure 13:
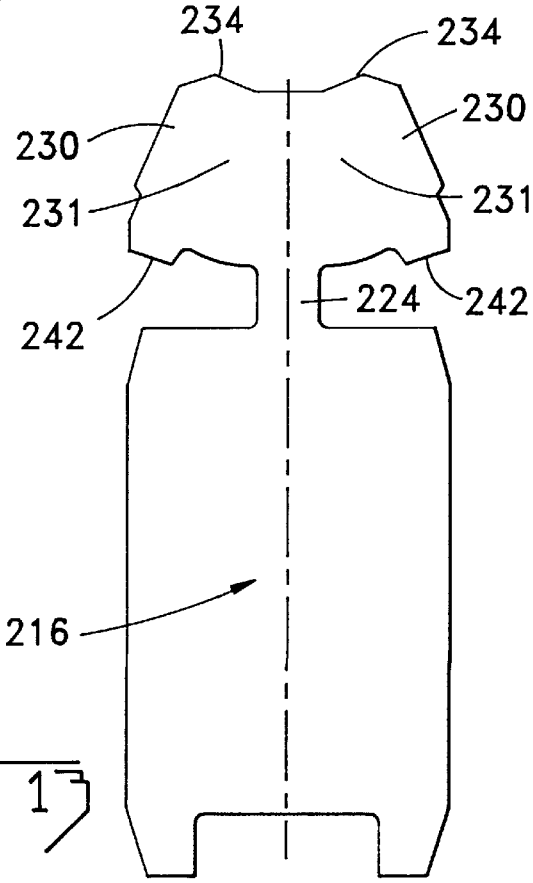
FIG. 13 is a plan view of the stamping used for forming the boardlock of FIG. 10.

With reference now FIGS. 3–5, the boardlock 14 be described in greater detail. The boardlock 14 includes the mounting portion 16 and the retention member 20 that are joined together in an L-shaped fashion by web 24. As the material from which the boardlock 14 is made is generally thin and the web 24 is small, it is possible that the retention portion 20 can move. However, this movement, in small distances may also be helpful in accommodating manufacturing tolerances.

The mounting portion 16 is a plate-like member having a pair of slightly bent ears that act to retain the boardlock 14 in the connector housing 4 by engaging the housing 4 along the groove 18, as is best seen in FIG. 2. On either side of the web 24 are two positioning tabs 28 that co-operate with features (not shown) within the housing 4 to prevent over insertion of the boardlock 14. The retention member 20 is basically of C-shape having a constant thickness therearound.

The retention member 24 includes a pair of resilient arms 30 extending outward form a bight 32 that is joined to the web 24 at one end. The plate 16 and retention member 24 are arranged generally perpendicular to each other. On each leg 30 opposite the web 24 are leading edges 34 that have chamfers 36 thereupon to aid in insertion into the hole in the substrate 9. The leading edges 34 and tabs 36 are formed on engagement teeth 38 separated from one another by a gap 40. Opposite the leading edge 34 are abutment surfaces 42 that are formed on support tabs 44 that, in this embodiment, will co-operate with the abutment surface 22 of the connector housing 4, as best seen in FIG. 2. The tabs 44 are desirably formed along the legs 30 outward from the web 24. A relieved portion 46 separates the tabs 44 from the web 24 and, as can be seen by examining FIG. 5, enables the formation of the positioning tabs 28. Furthermore, if desired, an additional tab 48 may be provided for stabilising the retention member 20.

In order to provide some understanding of the size of this embodiment of the present invention, the overall height from the leading surface 34 to the mounting portion 16 is in the order of 2.5 mm and the distance across the legs 30 is slightly larger than 2 mm so that when the retention member 20 is placed within a 2 mm diameter hole the arms 30 are deflected slightly and the connector is held in position as a result of the resilience thereof. It is envisioned that a connector utilising a pair of these boardlocks 14 would be mountable upon a 1.6 mm thick printed circuit board with a maximum force of 26 Newtons. It is further envisioned that these boardlocks 14 would provide sufficient retention to hold the connector 4 in place if the substrate were inverted and that the feet 8 of the contact 6 are held upon the circuit traces of the substrate 9 while surface mount soldering occurs.

With reference now to FIGS. 6–9, an alternative embodiment of the present invention is shown generally at 140. In describing the alternative embodiments, the reference number generally correspond to those used in describing the embodiment shown in FIGS. 3–5 with sequentially higher 100 series numbers. The boardlock 140 includes a mounting portion 116 generally configured as describe above. The retention member 120 also includes the features described above. However, where the retention member 120 extends from the web 124 the C-shape is formed beneath the mounting portion 116 by bending the arms 130 form the bight 132 in the direction opposite of that seen in the previously described embodiment. This is best seen by comparing FIG. 3 and FIG. 8. As a result of this, the abutment surfaces 142 are now disposed below the mounting portion 116. The distance D separating the two in the embodiment shown is in the order of 0.1 mm. In this embodiment, rather than the abutment surfaces 142 cooperating with the housing 4, they would abut the mounting portion 116.

With reference now to FIGS. 10–13, yet another embodiment of the present invention is shown generally at 214. A mounting portion 216 is joined to a retention member 220 by way of a web 224. The primary difference in this embodiment is that the retention 220 is fashioned such that the arms 230 and the bight 231 from which it extends are more linear in nature and joined together through rounded corners 231. Also the arms 230 and bight 232 taper such that at the leading edge 234 the retention member 220 has a smaller cross-section than at the end having closer to the abutment surfaces 242. This can be best seen in FIGS. 10–12. A construction such as this is to ease initial insertion into the mounting holes formed in the substrate.

Figure 14:
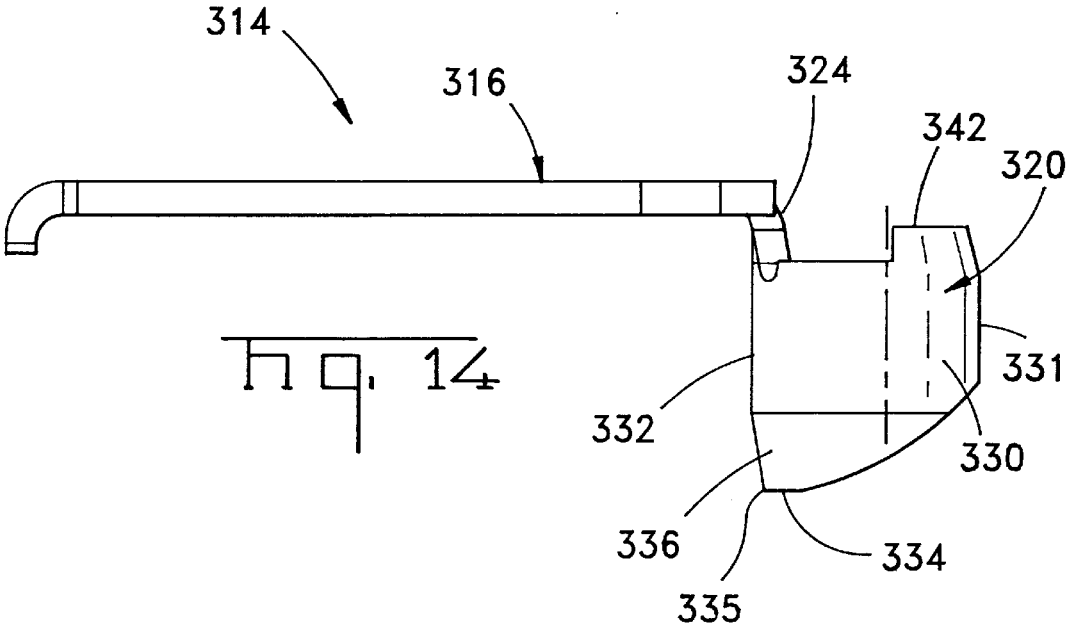
FIG. 14 is a side view of another embodiment of a boardlock according to the present invention.
Figure 15:
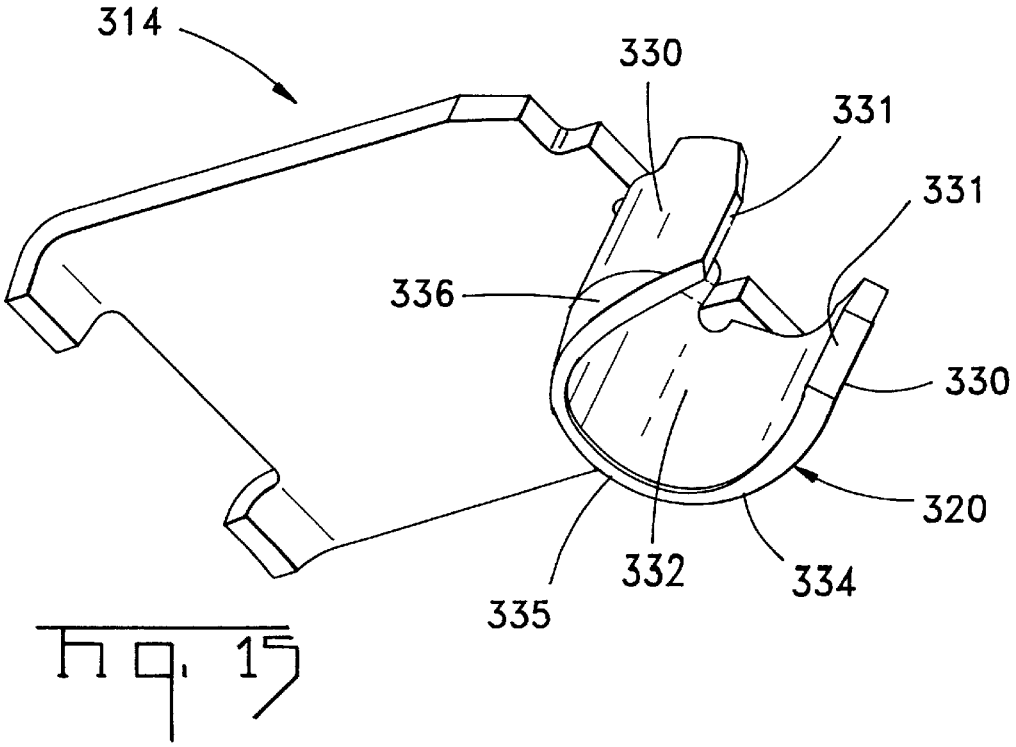
FIG. 15 is a bottom side perspective view of the boardlock of FIG. 14.

Finally, with reference to FIGS. 14 and 15 still yet another alternative embodiment of the present invention as shown generally at 314. The retention portion 320 that is connected to the mounting portion 316 by the web 324 is also configured in a C-like manner. However, the leading edge 334 extends in a tapered manner from the ends 331 of the arms 330 connected to the bight 332 to a single primary insertion point 335 at the bight 332. This reduces the possibility of skating the connector 4 across the substrate during the assembly operation by ensuring that proper engagement with the holes therein is established.

Therefore, the present invention allows the mechanical fixation of electrical connectors to substrates such as printed circuit boards without the need to extend thereacross. The present invention is especially useful for small connectors. The present invention enables stabilizing an with the boardlock to prevent the mounting force from destroying the boardlocks. The present invention also enables the use of minimum mounting force.

I/we claim:

1. An electrical connector for mounting on a substrate, the connector comprising;

a housing having a base surface and a boardlock for mechanically retaining the connector to the substrate the boardlock having a mounting portion fixed to the housing and a retention member, joined to the mounting portion by a web in an L-shaped manner, where the retention member is formed in a C-shape having a pair of resilient arms extending from a bight that is connected to the web and the retention member is extending outward from the base surface to be received in a hole in the substrate; characterized in that; the retention member includes abutment surfaces that cooperate with the connector to assure the retention members are properly received in the holes of the substrate.

2. The electrical connector of claim 1, wherein the retention member has leading edge away from the base surface with a chamber therealong for insertion into the hole.

3. The electrical connector of claim 2, wherein a tooth is formed along the leading edge for insertion in the hole.

* * * * *